United States Patent [19]

Hollowell et al.

[11] Patent Number: 4,535,501

[45] Date of Patent: Aug. 20, 1985

[54] BATTERY POWERED VACUUM TRASH COLLECTOR

[76] Inventors: John R. Hollowell, 22179 Long Blvd., Dearborn, Mich. 48124; John F. Hollowell, 6526 Sharon Dr., Garden City, Mich. 48135

[21] Appl. No.: 515,341

[22] Filed: Jul. 19, 1983

[51] Int. Cl.[3] ..... A47L 9/00

[52] U.S. Cl. ..... 15/339; 15/340; 15/412

[58] Field of Search ..... 15/340, 339, 412, 319; 318/442

[56] References Cited

U.S. PATENT DOCUMENTS

| | | | |
|---|---|---|---|
| 1,766,929 | 6/1930 | Naul | 15/412 X |
| 2,046,675 | 7/1936 | Daiger | 15/412 X |
| 3,184,775 | 5/1965 | Downey et al. | 15/412 X |
| 3,204,280 | 9/1965 | Campbell | 15/314 |
| 3,267,510 | 8/1966 | Cote | 15/344 |
| 3,570,040 | 3/1971 | Wada | 15/349 |
| 3,710,412 | 1/1973 | Hollowell | 15/340 |
| 3,854,164 | 12/1974 | Schmitz | 15/340 |
| 3,885,267 | 5/1975 | Maurer et al. | 15/339 |
| 4,011,624 | 3/1977 | Proett | 15/344 |
| 4,173,809 | 11/1979 | Ku | 15/319 |
| 4,196,492 | 4/1980 | Johnson et al. | 15/320 |
| 4,218,226 | 8/1980 | Boozer | 55/274 |
| 4,322,868 | 4/1982 | Wurster | 15/302 |
| 4,369,543 | 1/1983 | Chen | 15/319 |

*Primary Examiner*—Chris K. Moore

*Attorney, Agent, or Firm*—Harness, Dickey & Pierce

[57] ABSTRACT

A battery powered trash collector mountable on a cart in which the collector, comprised of a pivoted cylindrical bin having a hinged lid surmounted by a vacuum blower, is mounted on a frame to the cart. A flexible hose of inverted U-shape has a nozzle at its outer end adapted for abutting, nozzle closing engagement with the ground or other surface and is supported by a leaf spring secured to the hinged lid. The nozzle is controlled by a handle through a telescoping connection secured to the hose, and a pair of electrical energy sources are provided for energizing the D.C. motor driven vacuum blower. A switch is provided in the handle of the telescoping connection for momentarily energizing the motor while a series/parallel speed controller switch is provided for selectively energizing the motor at one of two given speeds for maximum energy efficiency.

15 Claims, 8 Drawing Figures

FIG. 1.
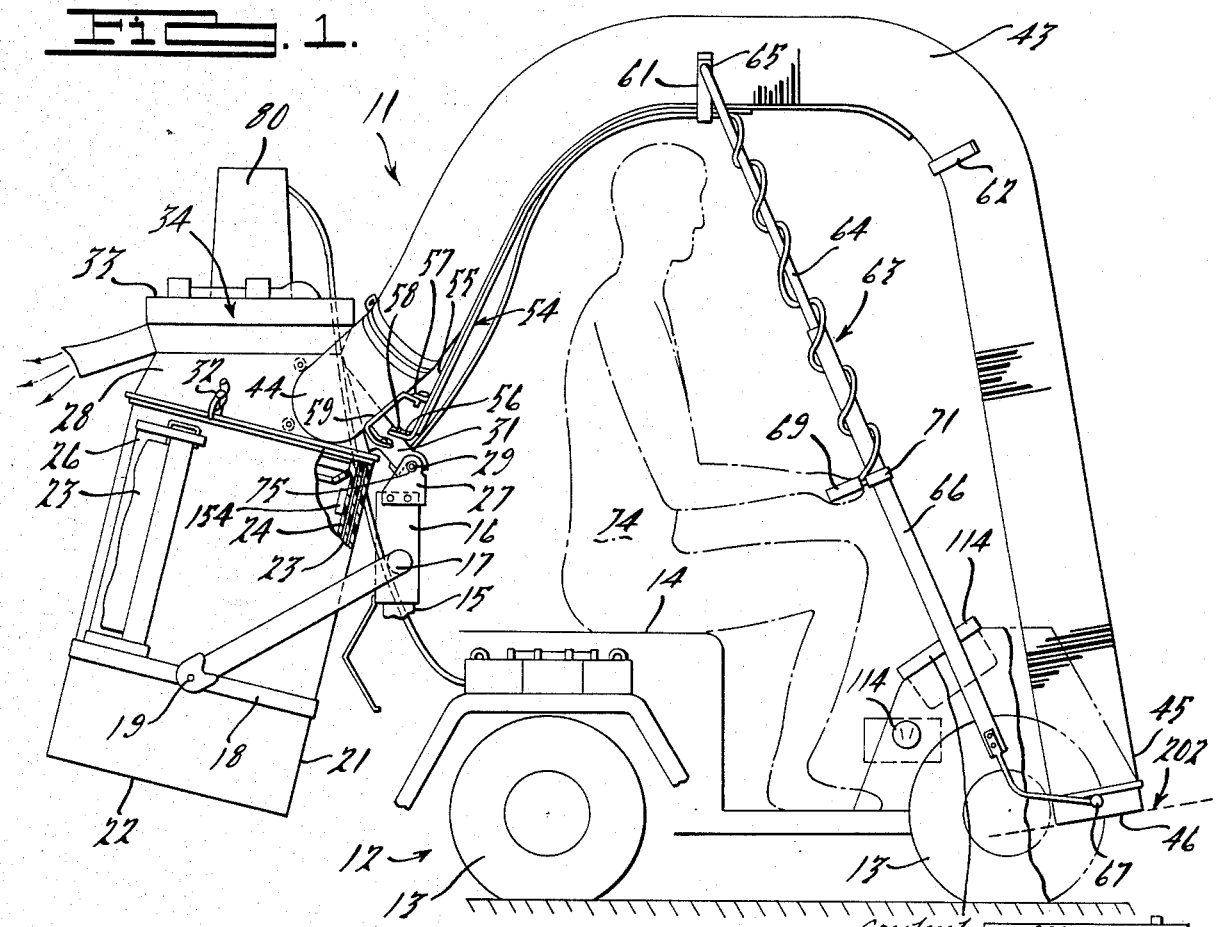
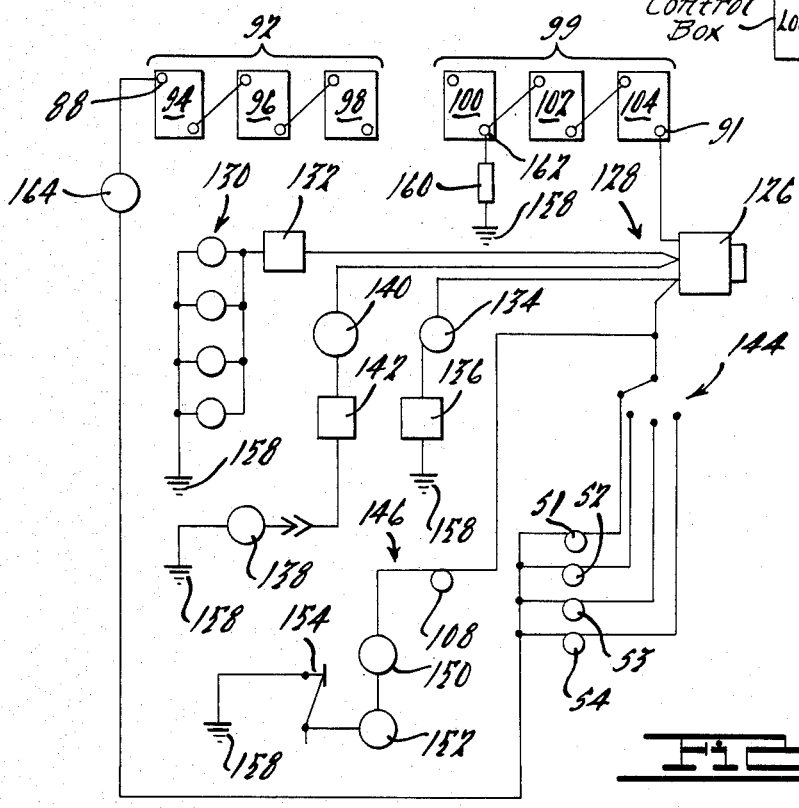
FIG. 3.

BATTERY POWERED VACUUM TRASH COLLECTOR

SUMMARY OF THE INVENTION

The vacuum trash collector of the present invention provides a quiet, efficient, and pollution free battery powered unit capable of operating at two different speeds for extended periods of time without recharging. In accordance with the invention a cylindrical collecting bin is pivoted to a U-shaped frame secured on a mobile cart or vehicle. The bin is provided with a lid which acts as a plenum chamber and has a vacuum blower disposed thereon including an impeller driven by a permanent magnet direct current motor. The permanent magnet direct current motor has a generally linear or straight line speed torque relationship such that the motor will run without exceeding a predetermined speed limit under no load conditions. A perforated bowl-shaped inlet baffle is secured to the blower shaft and is disposed within the lid. A flexible hose extends upwardly and outwardly from the lid having an inner end communicating with the plenum chamber and an outer end terminating in a generally downwardly disposed opening or nozzle. The hose is supported by a flexible spring, the inner end of which is pivotally mounted for transverse rocking movement on the lid support. A counter balance spring for the lid permits it to be lifted along with the blower. The nozzle is controlled by a handle through a telescoping connection connected to a midportion of the hose support and provides a means accessible to an operator for maneuvering the outer end of the hose.

The outer end or nozzle is disposed substantially in a flat plane and is arranged to permit the closing or blocking of the outer end or nozzle against a surface, such as the ground, thereby substantially diminishing the volume of air drawn into the plenum chamber through the hose when the motor is energized. By so blocking the outer end of the hose the load on the motor is substantially reduced, approaching a near no load condition. This causes the motor to approach the near no load speed limit with a corresponding increase in vacuum within the plenum chamber and bin, without the danger of overspeeding or burning out the motor. By placing the open end or nozzle over a piece of trash and so blocking the open end against the surface of the ground, an operator can cause the motor to temporarily approach the near no load speed limit thereby building up a substantial vacuum within the bin and plenum chamber. At the instant the nozzle is lifted from the surface of the ground a tremendous suction is generated characterized by the rapid inrush of air carrying with it the trash or debris. Unlike gasoline powered vacuum devices which employ governors to prevent overspeeding and hence run substantially at one continuous speed, the battery powered vacuum device of the present invention is capable of being repeatedly placed in the near no load condition by blocking the nozzle as described above, each time generating an instantaneous suction or inrush which is considerably greater than the suction developed by the device during steadystate operation. This capability affords a considerable savings in energy and prolonged battery life.

The electric circuit of the present invention which is coupled to the motor and provides driving current or energy thereto comprises first and second nodes which are connected to a first source of electrical energy such as a storage battery or bank of storage batteries. Third and fourth nodes are also provided for coupling to a second source of electrical energy such as a second storage battery or bank of storage batteries. The electrical potential or voltage of both of these electrical energy sources are nominally equal to one another. A manually operable switch is provided for selectively coupling the energy sources in either series or parallel to one another by selectively coupling, in the alternative, the second node to the third node, or the first node to the third node and the second node to the fourth node. By so doing, the motor may be energized at twice the electrical potential or voltage of either one of the energy sources alone (series connection) or at the electrical potential or voltage equal to either of the sources (parallel connection). This provides an efficient two-speed operation which takes full advantage of the stored electrical energy, at either operating speed, for operating a long time before recharging. To prolong the battery life even further, a manually operable switch is provided in the handle for momentarily energizing the motor only when suction is required. Through the use of this manually operable switch, and by judiciously selecting the slower, more energy efficient speed (parallel connection) unless the higher speed (series connection) is absolutely necessary, battery life can be dramatically prolonged. Moreover, by utilizing the unit's ability to generate increased suction by momentarily blocking the nozzle the instantaneous suction developed (even at the slower speed) is usually more than adequate for collecting broken glass, beverage can tabs, cigarette butts, can, cups (whole or flat), and generally most other loose materials capable of fitting through the unit's flexible hose.

BRIEF DESCRIPTION OF THE DRAWINGS

FIG. 1 is a side elevational view of the invention shown with portions of the cart on which it is mounted;

FIG. 3 is a schematic diagram illustrating the electrical control circuit of the present invention;

DESCRIPTION OF THE PREFERRED EMBODIMENT

Figure 2:
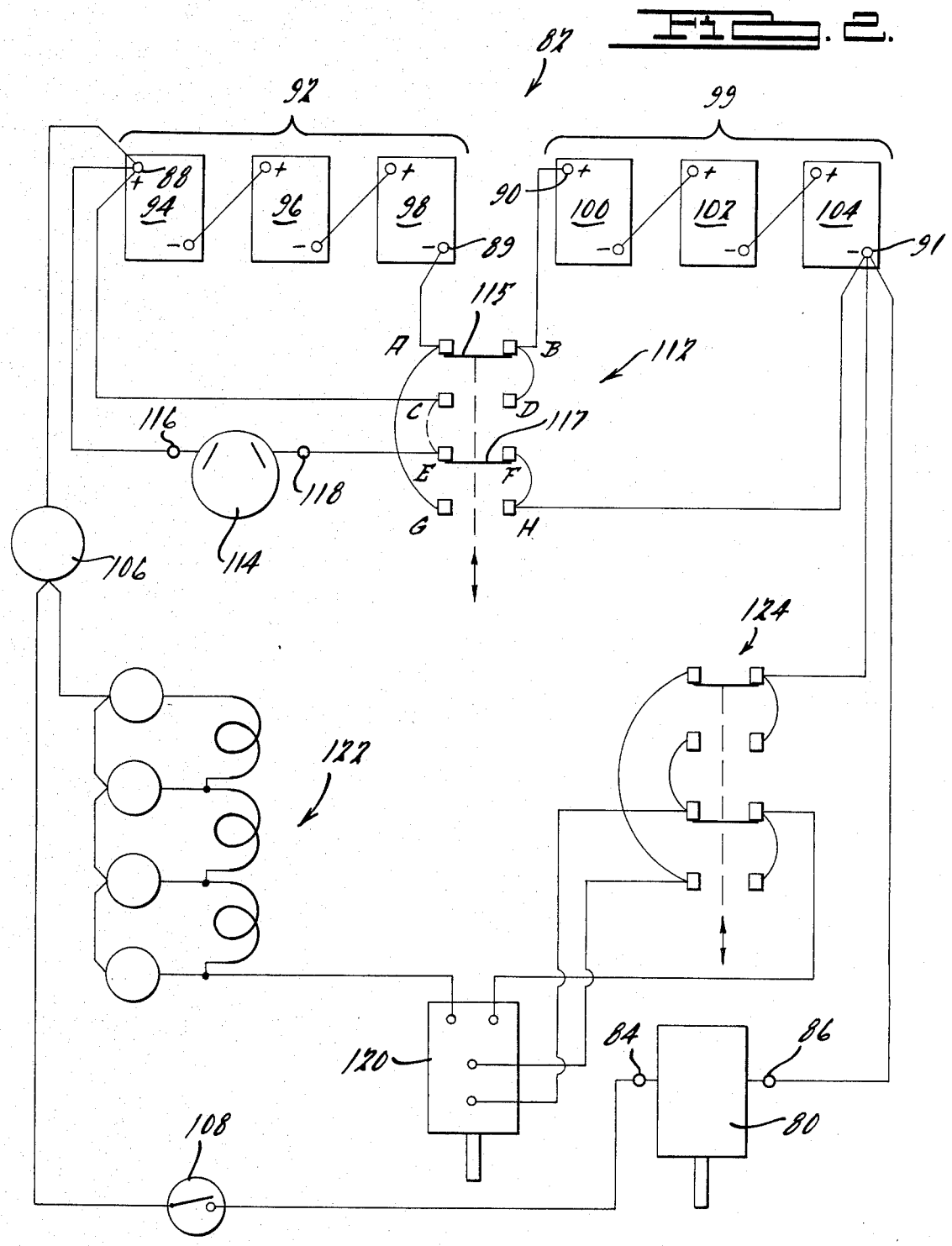
FIG. 2 is a schematic diagram illustrating the electrical power circuit of the invention.

The vacuum trash collector is generally indicated at 11 and is adapted to be mounted on a vehicle such as a cart generally indicated at 12 which is partially shown in FIG. 1. The cart may be any one of various types for movement along roadways, in industrial plants or buildings, or along other terrains to collect debris such as leaves, industrial refuse, roadside trash, or the like. The vehicle has wheels 13, and an operator's seat 14 and a vertical post shown partially at 15 behind the seat 14 on which unit 11 is supported. Forward movement of vehicle 12 is to the right in FIG. 1.

Unit 11 comprises a vertical socket 16 mountable on post 15 and a U-shaped member 17 secured to and extending downwardly and rearwardly from socket 16. Socket 16 and U-shaped member 17 together comprise a frame. A circular clamp 18 is pivoted at 19 to the arms of member 17 and supports a bin 21. This bin is of cylindrical or barrel shape having a closed bottom 22 and an open top. As shown, the bin is lined with a plastic bag 23 having a rigid liner 24 therewithin. This bag and a liner construction is more fully described in U.S. Pat. No. 3,740,933 entitled "Vacuum Trash Collector", issued June 26, 1973. For the purposes of this invention, however, bin 21 could be used without a bag 23 or liner 24.

Bin 21 is tiltable on pivot 19 between various positions to facilitate the placement of liner 24 and bag 23 therein and to facilitate emptying. In FIG. 1 bin 21 is shown in its trash collection position. A holder 26 is shown on the bin for storing and dispensing additional bags.

Figure 7:
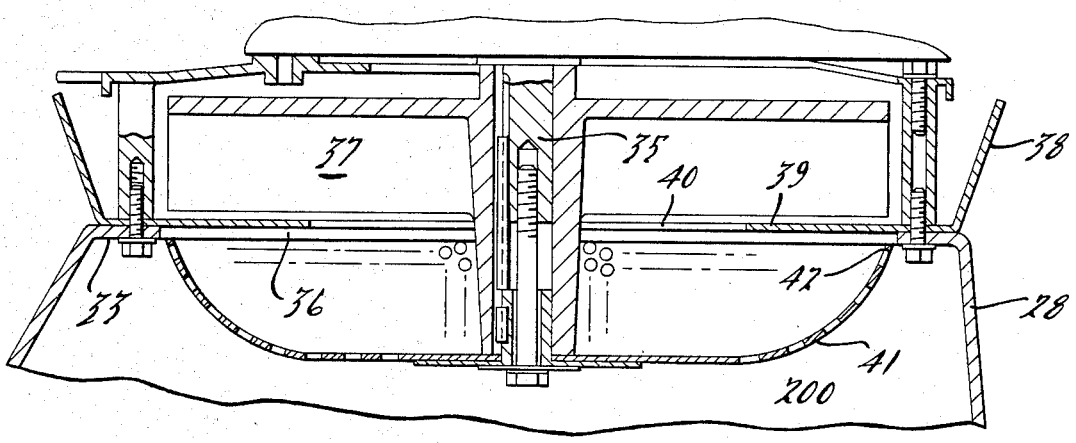
FIG. 7 is an enlarged cross-sectional view in elevation of the blower baffle and its associated parts.

A bracket 27 is secured to socket 16 and a lid 28 for bin 21 is pivoted at 29 to bracket 27 by means of an extension 31. Lid 28 is securable to the upper rim of bin 21 by clamps 32. When so connected, bin 21 is inclined slightly forward from the vertical as seen in FIG. 1. The lid is so shaped, however, that its top 33 is horizontal to support a vacuum blower 34. As shown in FIG. 7, this blower has a downwardly extending shaft 35 passing through a central aperture 36 in lid top 33. An impeller 37 is mounted on shaft 35 and draws air upwardly. A guard 38 surrounds impeller 37 and has an annular flap portion 39 partially overlapping opening 36. The opening 40 in portion 39 forms the inlet of the impeller.

A baffle 41 is secured to the lower end of shaft 35 below opening 36. Baffle 41 is of perforated disked shape, its upper edge 42 being closely adjacent the outer edge of aperture 36 so that the baffle overlaps inlet 40 of the impeller. The baffle will rotate with the vacuum blower so that any trash, leaves or other debris which come in contact with the baffle will be thrown off by centrifugal force and thus prevented from clogging the blower.

Lid 28 forms a plenum chamber 200 in which the air and debris are drawn through a flexible hose 43. One end of this hose enters an inlet 44 of lid 28 tangentially so that air will be swirled around within the lid with the debris being thrown out by centrifugal force and dropped into bin 21.

Hose 43 arches above seat 14, thus leaving room for an operator to sit, and then extends downwardly to its outer end 45. A nozzle 46 is defined at the outer end 45 of hose 43. The outer end 45 and nozzle 46 lie in a substantially flat plane denoted by dashed line 202 which facilitates the placement of end 45 and nozzle 46 flush against a surface such as the surface of the ground. As will be discussed more fully below, such placement flush against a surface blocks or substantially reduces the volume of air drawn into hose 43, thereby causing the vacuum blower motor to accelerate towards its near no load speed.

The means for supporting hose 43 and nozzle 46 comprises a leaf spring indicated at 54 in FIG. 1. This spring is attached to a bracket 56 with coaxial pivots 57 and 58 respectively, joined to a bracket 59 secured to the underside of inlet 44. U-shaped brackets 61 and 62 spaced along the leaf spring partially surround and support hose 43. A telescoping nozzle support generally indicated at 63 extends between bracket 61 and the nozzle. This support comprises an upper rod 64 pivoted at 65 to bracket 61, and a lower rod 66 pivoted at 67 by a forked lower end 68 to nozzle 46. A handle 69 is secured to a lower rod 66 by a bracket 71 and extends at right angles thereto. Thus, the operator may grasp handle 69 and maneuver nozzle 46 by lifting or lowering the nozzle, moving it forward or backwards, or swinging it from side to side. All of these movements will be permitted by the combination of inner pivot 57, 58, leaf spring 54, telescoping support 63 and the flexibility of the hose itself. Thus, a very wide area of maneuverability is afforded by the device with the operator sitting in one position. Substantially, the entire weight of the hose, nozzle and telescoping support will be carried by leaf spring 54 so that the effort of the operator can be devoted entirely to maneuvering rather than supporting the device.

Figure 4:
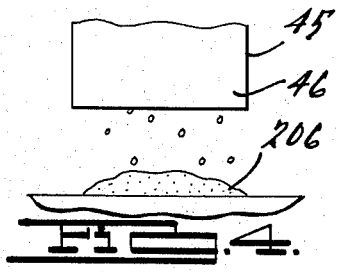
FIGS. 4 through 6 depict the outer end or nozzle of the flexible hose to illustrate the invention in operation.
Figure 5:
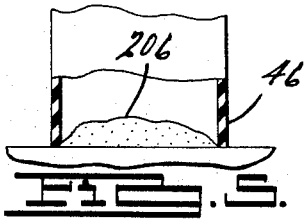
Figure 6:
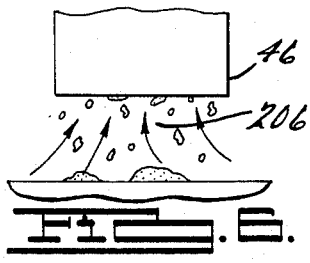
Figure 8:
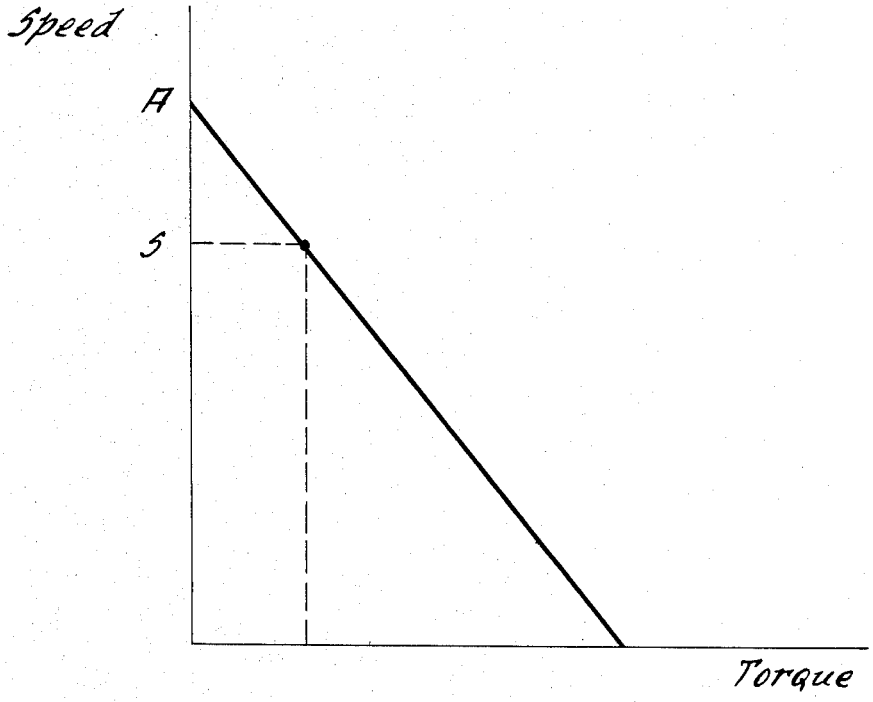
FIG. 8 is a graph depicting the torque-speed relationship of the blower motor.

Vacuum blower 34 is driven by a permanent magnet direct current (D.C.) motor 80. Motor 80 may be implemented to using a Honeywell BA53 permanent magnet motor, operable at a low speed of nominally, 2,400 r.p.m. when energized at 18 volts, and operable at a high speed of nominally 3,450 to 4,250 r.p.m. when energized at 36 volts. In practice the actual motor speed may vary somewhat depending on the diameter of flexible hose 43. Motor 80 has a straight line speed torque relationship as shown in FIG. 8. Under no load conditions as exemplified by point A on the speed torque curve of FIG. 8 the motor speed reaches a predetermined finite value. Hence motor 80 is self-governing and will not overspeed or burn out when the outer end 45 or nozzle 46 of hose 43 is blocked off. With reference to FIGS. 4 through 6 a technique for lifting refuse, which will be discussed more fully below, is illustrated which takes advantage of this speed torque relationship of motor 80 and its ability for approaching without exceeding a predetermined no load speed limit. The technique, referred to herein as slurp, is particularly useful in conserving the batteries by permitting the operator to develop momentary or instantaneous inrushes which exceed the steadystate vacuum developed. For example, utilizing the Honeywell 36 volt BA53 motor at 36 volts excitation the steadystate speed is nominally 3,500 r.p.m. while the near no load speed approached when the nozzle is locked is nominally 4,200 r.p.m. At 18 volts excitation the steadystate and near no load speeds are nominally 2,450 r.p.m. and 2,800 r.p.m. respectively.

While the permanent magnet D.C. motor is presently preferred, the invention may be implemented using other motors which exhibit comparable speed torque relationships, i.e. those which approach a finite speed limit at no load. A compound D.C. motor may, therefore, be utilized to implement the invention.

Referring now to FIG. 2 the electric power circuit of the invention will now be described. The electric control circuit designated generally be reference numeral 82 is coupled to motor 80 as at terminals 84 and 86 and provides the electrical power for energizing motor 80. Circuit 82 includes nodes 88, 89, 90 and 91 for coupling to a source or sources of electrical energy more specifically as follows. Nodes 88 and 89 are coupled to a first source of electrical energy 92, which may preferably be implemented using a storage battery or bank of series connected storage batteries such as batteries 94, 96 and 98. Similarly, nodes 90 and 91 are coupled to a second source of electrical energy 99 which may preferably be implemented using a storage battery or bank of series connected storage batteries such as batteries 100, 102 and 104. While battery powered energy sources are presently preferred, the invention may also be implemented using energy sources employing electronic motor controllers, as will be recognized by those skilled in the art.

Node 91 is coupled to terminal 86 of motor 80, while node 88 is coupled to terminal 84 of motor 80 via circuit breaker 106 and solenoid 108. Solenoid 108 is responsive to operator control through a manually operable trigger switch 152 (shown in FIG. 3) which may be mounted in the handle 69 for manipulation by the operator. The invention further comprises a double pole, double throw center off speed selector and battery charge selector switch 112 which is coupled to motor 80 and also to nodes 88, 89, 90 and 91. Switch 112 is preferably mounted in a control box such as control box 114, as shown in FIG. 1, within easy reach of the operator and may be selectively manipulated among LOW, OFF, HIGH/CHARGE settings. In LOW setting energy sources 92 and 99 are connected across motor terminals 84 and 86 in parallel with one another, thus if batteries 94, 96, 98 and batteries 100, 102 and 104 are each six volts then a total voltage of eighteen volts will be applied across terminals 84 and 86 of motor 80 in the LOW setting. In the OFF setting no voltage is applied across terminals 84 and 86 and hence motor 80 is inactive. In the HIGH/CHARGE setting energy sources 92 and 99 are connected in series with one another across terminals 84 and 86. Hence, assuming batteries 94, 96, 98 and batteries 100, 102 and 104 are each six volts, then the combined voltage applied to motor 80 will be thirty six volts in the HIGH/CHARGE setting.

More specifically, switch 112 has a first pair of terminals A and B, a second pair of terminals C and D, a third pair of terminals E and F, and a fourth pair of terminals G and H. Switch contact 115 may be toggled from shorting engagement between terminals A and B, through a center "OFF" position, into shorting engagement between terminals C and D. Contact 117, ganged to contact 115 may be toggled from shorting engagement between terminals E and F, through center "OFF", to shorting engagement between terminals G and H. Terminal A is coupled to node 89 while terminal B is coupled to node 90, thus when switch 112 is set in the HIGH/CHARGE setting terminals A and B are shorted together through the switch, connecting nodes 89 and 90 with one another. Terminal C is coupled to node 88 while terminal D is coupled to node 90. Hence when switch 112 is thrown in the LOW direction, terminals C and D are shorted together connecting nodes 88 and 90 with one another. In order to provide means for recharging the battery banks the invention includes a recharger receptacle or socket 114 having a first terminal 116 coupled to node 88 and having a second terminal 118 connected to terminal E of switch 112. Terminal F of switch 112 is coupled to node 91, and hence when it is desired to recharge the battery banks or energy storage sources, switch 112 is thrown into the HIGH/CHARGE setting whereby terminals E and F are shorted together. This, in effect, couples node 91 with terminal 118 thereby placing recharging receptacle 114 in parallel across nodes 88 and 91. Since switch contacts 115 and 117 are ganged together, terminals A and B are also shorted together, in effect placing energy storage sources 92 and 99 in series with one another. Thus, energy sources 92 and 99 may be recharged by connecting receptacle 114 to an appropriate source of D.C. energy at the voltage of the series connected energy sources, i.e. assuming each of the individual batteries 94, 96, 98, 100, 102 and 104 are six volts and connected as shown in FIG. 2, the required recharger voltage would be nominally thirty six volts. If desired, a recharger can be conveniently carried by the vehicle to allow quick recharges at lunch time or full recharges overnight. Terminal G is coupled to node 89 while terminal H is coupled to node 91. Thus when switch 112 is thrown in the LOW direction, terminals G and H are shorted together through contact 117, thereby connecting nodes 89 and 91 together. Since contact 115 is ganged with contact 117, in the LOW setting, terminals C and D would also be shorted together, thereby coupling nodes 88 and 90 together. Thus, it will be seen that in the LOW setting energy sources 92 and 99 are connected in parallel with one another. With reference to FIG. 2, batteries 94, 96, 98, 100, 102 and 104 have been labeled with positive and negative terminals as shown. It will be recognized, however, that the polarities of the aforementioned batteries may all be reversed, with the appropriate reversal of motor terminals 84 and 86, without departing from the spirit of the invention.

While the invention thus described may be mounted on a nonmotorized pushcart, or the like, in a presently preferred embodiment the invention is mounted on a motorized vehicle, as diagramatically illustrated in FIG. 1. The vehicle is propelled by motor 120, which may be implemented using a GE thirty six volt—A55 D.C. motor. Motor 120 is energized from energy sources 92 and 99 as shown in FIG. 2. The energizing circuit includes a bank of tapped resistances 122, coupled to an accelerator pedal, for increasing and decreasing the motor speed in small finite steps. The vehicle motor circuit also includes a direction reversing or forward/reverse switch 124, coupled to motor 120 as shown for reversing the current flow to permit the vehicle to drive both forwards and backwards. In addition to the tapped resistor 122 "accelerator pedal" the vehicle speed is also controlled by switch 112 which serves to couple energy sources 92 and 99 in either series or parallel across motor 120, in the same fashion as was described in connection with motor 80. Hence the vehicle is capable of being propelled in incrementally variable speed steps (controlled by the accelerator pedal) over two different speed ranges (controlled by switch 112). For maximizing battery life the vehicle may be driven while in the LOW (parallel) switch 112 setting. This has the advantage of permitting the accelerator pedal to be depressed more nearly to the floor of the vehicle than in the HIGH/CHARGE switch setting. With the accelerator pedal to the floor, or nearly to the floor, a fewer number of resistances 122 are switched in series with motor 120. Hence less energy is wasted in resistances 122 as heat.

Referring now to FIG. 3, the control circuit of the present invention will now be described. The control circuit is powered by energy storage sources 92 and 99. It will be understood that switch 112, as well as certain other components, have been eliminated from FIG. 3 for illustration purposes only. The control circuit further comprises a key operated switch 126 for turning the control circuit on and off in a fashion similar to the automotive ignition switch. Switch 126 is coupled to node 91 and provides a plurality of leads 128 for connection to various electrically operated devices on the vehicle. Specifically, these devices include one or more lights 130, such as headlights for night time use. Lights 130 are activated by switch 132 coupled in series between lights 130 and switch 126. The vehicle also includes brake lights 134 coupled to switch 126 and energized by a brake light switch 136, which may be coupled to the brake foot pedal of the vehicle. For safety a flasher light 138 is included, which may be mounted on the vehicle, preferably at an elevated height by means of a vertical pole or the like for increased visibility. Flasher light 138 is controlled by a light flasher module, such as the type employed in the automotive industry, and the flasher light circuit is provided with an on/off switch 142 for activating and deactivating the flasher light. The entire flasher light circuit is coupled to switch 126 to receive electrical energy therefrom.

As discussed above, the vehicle motor 120 is controlled by a bank of tapped resistances 122 for controlling the speed of the vehicle in small discrete increments. This is accomplished by means of a rotary accelerator pedal switch 144 coupled to switches or solenoids S1, S2, S3 and S4. These switches or solenoids in turn progressively activate or select different resistances of resistor 122, as shown in FIG. 2. Energy for the accelerator pedal circuit is supplied from switch 126.

Similary, energy for the vacuum control circuit, denoted generally be reference numeral 146 is used to energize or deenergize vacuum solenoid 108 which was discussed in connection with FIG. 2. Solenoid 108, it will be recalled, applies power to vacuum motor 80. Circuit 146 includes a thermal cutout switch 150, trigger switch 152, and cutoff switch 154 in series with one another. Thermal cutout switch 150 is normally closed and opens only when motor 80 overheats. Trigger switch 152 is manually operable by the operator and functions to turn vacuum motor 80 on and off as desired. Preferably switch 152 is a diaphragm switch or pneumatic switch operated by an air bulb or air pressure switch 153 located in the handle 69, as shown in FIG. 1. More specifically, the air bulb trigger switch provides a momentary "on" pneumatic signal to switch 152 through air line 156 coiled around the telescoping support rod 64. While the use of a pneumatically controlled switch is presently preferred, other switch arrangements including electrical switches disposed on handle 69 may also be utilized without departing from the spirit of the invention. Cutoff switch 154 employs a flapper disposed within the plenum as shown in FIG. 1. This switch is responsive to the trash or debris within the bin and breaks the vacuum control circuit when a predetermined quantity of trash is present within the bin. Thus, cutoff switch 154 prevents the bin from becoming overfilled.

With continued reference to FIG. 3, it will be seen that lights 130, brake lights 134, flasher lights 138, and vacuum control circuit 146 are each coupled to system ground node 158. By virtue of fused connection 160 between ground mode 158 and battery terminal 162, the aforementioned lights and vacuum control circuit operate at a supply potential equal to the sum of batteries 102 and 104. Thus, assuming all batteries are nominally six volts, the aforementioned lights and circuit operate at a twelve volt potential. In contrast, the accelerator pedal circuit through switch 144 is coupled between switch 126 and node 88 via circuit breaker 164. Thus, the accelerator pedal circuit operates at the combined voltage of energy sources 92 and 99, i.e. thirty six volts, series or eighteen volts, parallel, assuming six volt batteries are used.

In operation the operator shown in dashed lines at 74 will be seated on seat 14 of the cart which may be propelled and steered by any conventional means (not shown). The operator will grasp handle 69, and, with the vehicle moving forwardly (to the right in FIG. 1) will direct nozzle 46 toward the litter or other debris, and will momentarily depress air bulb actuator 153 of trigger switch 152 to energize motor 80 and blower 34. Suction created by energizing motor 80 draws the leaves or other debris upwardly through tube 43 into the plenum chamber formed by lid 28. By centrifugal force the debris will be thrown outwardly against the inner surface of the lid and will drop into bin 21. Baffle 41 will stop any debris tending to enter the blower and will throw it outwardly by centrifugal force so that it will drop into the bin.

During operation, the operation may direct nozzle 46 either along side or in front of vehicle 12. When it is desired to empty the bin, clamps 32 will be released and lid 28 along with blower 34 swung upwardly. For this purpose a counter balance spring 75 may be provided on pivot 29, this spring having one end engaging the bracket 27 and the other bracket 31. Spring 75 is strong enough to lift not only lid 28 but the parts mounted thereon including blower 34 and hose inlet 44 and the weight of the boom provides counterbalance as well.

Bin 21 may then be swung to its emptying position in which the opening of the bin is presented in a downwardly and rearwardly disposed position to permit bag 23 to be withdrawn. If it is desired to reline bin 21 with a bag 23, such a bag may be withdrawn from container 26 and torn off a roll or otherwise removed, and then placed in bin 21 along with a liner 24 if this is being used. The bin would then be swung back to the operating position shown in FIG. 1 and lid 28 reclamped thereto.

The unit may be operated in either the LOW setting or the HIGH/CHARGE setting. The HIGH/-CHARGE setting is useful for transporting the vehicle from one place to another at high speeds, although it is also possible to operate the vacuum in this setting whether the vehicle is being propelled or not. The HIGH/CHARGE setting is also used during battery recharging. The LOW setting provides slower transport speeds and is particularly useful for conserving battery voltage. In one useful technique the operator selects the LOW setting and drives enroute to a pile of trash or leaves at a moderate speed. When the trash or leaves are within reaching distance of nozzle 46, the operator directs nozzle 46 towards the trash or leaves and momentarily depresses switch 152. It is by virtue of this manually controlled hand switch 152 in combination with the series parallel to speed motor controlling circuit that enables the trash collector of the invention to operate significantly longer on a single battery charge.

The motor controller circuit is further energy efficient inasmuch as it is usually possible to operate the unit in the LOW setting with energy sources 92 and 99 in parallel, saving the HIGH/CHARGE setting for transporting the vehicle from place to place at high speed or for vacuuming particularly stubborn or heavy trash. Although the HIGH/CHARGE setting does provide a convenient ready reserve of greater suction power, the electric motor driven system of the invention may also be operated in the slurp mode mentioned above for further energy savings and prolonged battery life. The ability to function in this slurp mode is not duplicated in prior art gasoline engine driven systems. More specifically, with reference to FIGS. 4, 5 and 6 the technique for lifting stubborn trash by utilizing the slurp action is illustrated. Nozzle 46 on end 45 is placed over a pile of stubborn refuse 206 as shown in FIG. 4. Motor 80 would be running at a steadystate speed largely determined by the diameter of hose 43, the characteristics of the motor, and the inefficiencies or energy consumed by turning the impeller. This steadystate speed is denoted by reference numeral S in FIG. 8. Next, nozzle 46 is placed over trash 206 so that nozzle 46 abuts the ground thereby closing off or substantially restricting the end 45 of hose 43. This reduces substantially the volume of air drawn through hose 43. The impeller, now with less work to perform, offers less resistance on motor 80 and motor 80 speeds up approaching its no load speed limit. The no load speed limit is denoted by reference character A in FIG. 8. At the same time a greater than steadystate vacuum builds up within the plenum chamber waiting to be released. In FIG. 6 nozzle 46 is lifted from the surface of the ground releasing the stored vacuum. A rapid inrush of air occuring at the instance of vacuum release draws trash 206 into hose 43. Motor 80 returns once again to its steadystate operating speed S.

The invention, thus described, provides a quiet, efficient and pollution free battery powered vacuum trash collector capable of operating at two speeds for extended periods of time without recharging.

While it will be appreciated that the preferred embodiment of the invention disclosed is well calculated to fulfill the objects above stated, it will be appreciated that the invention is susceptible to modification, variation and change without departing from the proper scope or fair meaning of the subjoined claims. For example, a D.C. motor having at least two field windings can be used to implement the dual speed vacuum blower motor. The windings could be selectively switched, as with a LOW-HIGH switching means, into and out of electrical connection with the energy source to effect low and high speed operation. In such an embodiment one of the two field windings consumes more energy (higher current) and thus causes the motor to run faster, even if the applied voltage is the same for high and low speeds. Or for another example, energy storage batteries could be replaced with equivalent power supplies having electronic controllers. Such controllers could be used as variable duty cycle pulse generators or choppers to control the energy delivered to, and consumed by the vacuum blower motor and thus effect multispeed operation. Also, while a dual speed or multispeed operation is presently preferred, a continuously variable embodiment is contemplated within the scope of the invention.

I claim:

1. A mobile vacuum trash collector comprising a bin, a lid mounted on said bin which acts as a plenum chamber, a vacuum blower disposed on said lid, a direct current motor having a predetermined finite no load speed limit coupled to said vacuum blower and operable to produce a steady state suction under load, means for connection to a storage battery power source for energizing said motor, a flexible hose having an inner end communicating with said plenum chamber and an outer end, means accessible to an operator for maneuvering said outer end, said outer end disposed substantially in a flat plane and arranged to permit the closing of said outer end against a surface thereby substantially diminishing the volume of air drawn into said plenum chamber causing said motor speed to approach said speed limit, and thereby developing a greater than steady state suction when said outer end is removed from against said surface;

said trash collector further comprising electrical circuit means having first and second nodes for coupling to a first source of electrical energy and having third and fourth nodes for coupling to a second source of electrical energy, and switching means coupled to said nodes and to said motor and operable between a series connected position in which said second node is coupled to said third node and a parallel connected position in which said first node is coupled to said third node and said second node is coupled to said fourth node, said series providing greater suction than said parallel position and said parallel position providing greater energy economy than said series position.

2. A mobile vacuum trash collector comprising a bin, a lid mounted on said bin which acts as a plenum chamber, a vacuum blower disposed on said lid, a flexible hose having an inner end communicating with said plenum chamber and an outer end, direct current motor coupled to said vacuum blower, electrical circuit means coupled to said motor having first and second nodes for coupling to a source of electrical energy and having third and fourth nodes for coupling to another source of electrical energy and switching means coupled to said nodes and to said motor and operable between a series connected position in which said second node is coupled to said third node and a parallel connected position in which said first node is coupled to said third node and said second node is coupled to said fourth node, said series position providing greater suction than said parallel position and said parallel position providing greater energy economy than said series position.

3. The apparatus of claim 2 wherein said motor comprises a permanent magnet motor.

4. The apparatus of claim 2 further comprising manually operable switching means disposed remotely from said motor having a normally resting position wherein said motor is prevented from being energized and being manually actuable to an actuating position wherein said motor is energized, said switching means being operative to automatically return to said resting position when not manually actuated, thereby conserving stored energy.

5. The apparatus of claim 4 further comprising means accessible to an operator for maneuvering said outer end of said flexible hose and wherein said manually operable switching means is disposed on said means for maneuvering said outer end for momentarily energizing said motor.

6. The apparatus of claim 2 further comprising means accessible to an operator for maneuvering said outer end of said flexible hose.

7. The apparatus of claim 2 wherein said first and second nodes are adapted for coupling to a first storage battery means and said third and fourth nodes are adapted for coupling to a second storage battery means.

8. The apparatus of claim 2 further comprising first storage battery means coupled to said first and second nodes and second storage battery means coupled to said third and fourth nodes.

9. The apparatus of claim 8 wherein said first and second storage battery means have nominally the same electrical potential.

10. The apparatus of claim 2 wherein said motor is a permanent magnet motor having a predetermined no load speed limit and said outer end of said flexible hose is so constructed and arranged to permit the closing of said outer end against a surface thereby substantially diminishing the volume of air drawn into said plenum chamber causing said motor speed to approach said speed limit.

11. The apparatus of claim 1 wherein said motor is a permanent magnet motor.

12. The apparatus of claim 2 further comprising second motor means for propelling said vehicle.

13. The apparatus of claim 12 wherein said second motor means is coupled to said electrical circuit means.

14. The apparatus of claim 13 wherein said second motor means is coupled to said first and fourth nodes.

15. A mobile vacuum trash collector comprising:

a vehicle;

a bin carried on said vehicle;

a lid mounted on said bin which acts as a plenum chamber;

a vacuum blower disposed on said lid;

a flexible hose having an inner end communicating with said plenum chamber and an outer end;

a direct current blower motor coupled to said vacuum blower;

a direct current drive motor for propelling said vehicle;

a power supply circuit carried on said vehicle, said circuit having first and second energy storage means, and having a pair of output terminals and further having a manually operable first swiching means for selectively coupling said first and second storage means in series or in-parallel across said output terminals;

wherein said blower motor and drive motor are coupled to said output terminals to receive electrical energy therefrom;

a second switching means accessible to an operator and remotely located from said blower motor and being coupled between one of said terminals and said blower motor, for normally interrupting the usage of electrical energy by said blower motor and for delivering electrical energy to said blower motor when actuated by an operator; and wherein actuation of said second switching means energizes said blower motor causing said vacuum blower to create suction within said hose and also reducing the electrical energy available to said drive motor, thereby causing said drive motor to run more slowly.

* * * * *